US011834758B2

(12) United States Patent
Okuda et al.

(10) Patent No.: US 11,834,758 B2
(45) Date of Patent: Dec. 5, 2023

(54) CARBON FIBER BUNDLE AND PRODUCTION METHOD THEREFOR

(71) Applicant: Toray Industries, Inc., Tokyo (JP)

(72) Inventors: Haruki Okuda, Iyo-gun (JP); Jun Watanabe, Iyo-gun (JP); Fumihiko Tanaka, Iyo-gun (JP)

(73) Assignee: Toray Industries, Inc., Tokyo (JP)

( * ) Notice: Subject to any disclaimer, the term of this patent is extended or adjusted under 35 U.S.C. 154(b) by 715 days.

(21) Appl. No.: 16/975,159

(22) PCT Filed: Mar. 5, 2019

(86) PCT No.: PCT/JP2019/008616
§ 371 (c)(1),
(2) Date: Aug. 24, 2020

(87) PCT Pub. No.: WO2019/172247
PCT Pub. Date: Sep. 12, 2019

(65) Prior Publication Data

US 2020/0399789 A1 Dec. 24, 2020

(30) Foreign Application Priority Data

Mar. 6, 2018 (JP) ..... 2018-039724
Aug. 30, 2018 (JP) ..... 2018-161055

(51) Int. Cl.
*D01F 9/22* (2006.01)

(52) U.S. Cl.
CPC ..... *D01F 9/22* (2013.01)

(58) Field of Classification Search
CPC ..... D01F 9/22; D01F 9/18; D01F 6/18
USPC ..... 8/115.5, 140; 428/367
See application file for complete search history.

(56) References Cited

U.S. PATENT DOCUMENTS

| | | | |
|---|---|---|---|
| 4,051,659 | A | 10/1977 | Blakelock |
| 2007/0193246 | A1 | 8/2007 | Schneider |

FOREIGN PATENT DOCUMENTS

| | | | |
|---|---|---|---|
| EP | 3 006 611 | A1 | 4/2016 |
| JP | 51-105419 | A | 9/1976 |
| JP | 58-87321 | A | 5/1983 |
| JP | 2002-001725 | A | 1/2002 |
| JP | 2006-009208 | A | 1/2006 |
| JP | 2006-231922 | A | 9/2006 |
| JP | 2008-509298 | A | 3/2008 |
| JP | 2014-141761 | A | 8/2014 |
| JP | 2015-067910 | A | 4/2015 |
| WO | 2014/196432 | A1 | 12/2014 |

*Primary Examiner* — Camie S Thompson
(74) *Attorney, Agent, or Firm* — DLA Piper LLP (US)

(57) ABSTRACT

A carbon fiber bundle that satisfies retaining a twist count of 2 turns/m or more when suspended with one end fixed and the other end free; having a single fiber diameter of 6.1 μm or more and a heat loss rate at 450° C. of 0.15% or less, and formula (1) wherein $L_c$ is crystallite size and $\pi_{002}$ is an orientation parameter of crystallites determined from bulk measurement of the entire fiber bundle: $\pi_{002}>4.0\times L_c+73.2$ (1); and a carbon fiber bundle that satisfies: retaining a surface layer twist angle of 0.2° or more when suspended with one end fixed and the other end free; having a single fiber diameter of 6.1 μm or more and a heat loss rate at 450° C. of 0.15% or less, and formula (1).

16 Claims, No Drawings

CARBON FIBER BUNDLE AND PRODUCTION METHOD THEREFOR

TECHNICAL FIELD

This disclosure relates to a carbon fiber bundle and a production method therefor.

BACKGROUND

High in specific strength and specific modulus, carbon fibers produce members having drastically reduced weight when used as reinforcing fiber for fiber reinforced composite materials and, accordingly, it is used in a wide range of fields as an indispensable material for realizing a society with high energy utilization efficiency. On the other hand, to accelerate their use in fields characterized by strong cost consciousness such as production of automobiles and housing of electronic instruments, it is essential to reduce the cost required for carbon fiber reinforced composite materials, which are still often expensive compared to other industrial materials. In addition to the price of the carbon fiber bundles themselves, it is important to reduce the molding cost, which account for a high proportion of the final product price. Among the elements affecting the molding cost, those which depend on the characteristics of carbon fiber bundles include the handling property of fiber bundles and high-order processability, and there are strong demands for carbon fiber bundles with strong bundle forming property that are high in handleability and high-order processability to realize the automation of molding processes for carbon fiber reinforced composite materials, which still often rely on manual operations.

Currently, the most common technique to impart a bundle forming property to carbon fiber bundles is treatment with a sizing agent. Specifically, the sizing agent covering the fiber surface allows the single fibers to join together to form bundles, and the structure of the fiber bundle will be stabilized during handling. In addition, their resistance to scraping with the roller, guide and the like during the molding step will be increased and fuzz generation will be suppressed, leading to improve high-order processability. However, depending on the intended uses and the method adopted for molding, a sizing agent alone will be unable to realize a required level of bundle forming property, and a decreased deposition of a sizing agent will be desired to reduce formation of thermal degradation products attributed to the sizing agent in some processes that involve molding at high temperatures, suggesting that the use of a sizing agent to impart bundle forming property is not always effective. Therefore, it is expected that there will be a demand in the future for a technique to allow a carbon fiber bundle itself to have bundle forming property, instead of using a sizing agent.

In synthetic fibers, there are many known techniques such as twisting and knitting to allow fiber bundles to form a specific structure to realize increased handleability or high-order processability. Techniques that make effective use of twisting are also seen in the field of fiber reinforced composite materials and, for example, there is a proposal of a technique to increase the production efficiency of a fiber reinforced resin strand production process by twisting a fiber bundle while impregnating the matrix resin to suppress the deposition of fuzz during the production process (Japanese Unexamined Patent Publication (Kokai) No. 2006-231922). Furthermore, there are other proposed techniques to provide final products having twists, including wire of carbon fiber formed of a twisted carbon fiber bundle impregnated with a matrix resin (International Publication WO 2014/196432), a sewing thread formed of two or more carbon fiber bundles twisted together (Published Japanese Translation of PCT International Publication JP 2008-509298), and a roll formed by scrolling twisted carbon fiber (Japanese Unexamined Patent Publication (Kokai) No. 2002-001725). Other examples of proposals focused on carbon fiber itself include a technique to perform stabilization, pre-carbonization, and carbonization of a twisted precursor fiber bundle for polyacrylonitrile based carbon fiber to enhance the processability and productivity in the stabilization step (Japanese Unexamined Patent Publication (Kokai) No. SHO-58-087321), and a technique to entangle or twist pre-carbonized fiber bundles to suppress fuzz generation that may occur in a high tension state (Japanese Unexamined Patent Publication (Kokai) No. 2014-141761). In addition, there is a generally practiced technique in which the expansion of fiber bundles in a carbon fiber bundle molding step is suppressed by wetting them with water to develop temporarily bundle forming property by capillary force.

The techniques described above, however, have problems as follows.

Although the techniques proposed in JP '922, WO '432 and JP '298 can provide final molded products that contain carbon fiber bundles having enhanced fiber bundle forming property, they have no effect on the bundle forming property at the stage of subjecting the untwisted carbon fiber bundles to the molding step. Many times, furthermore, the carbon fiber bundles are already treated with a sizing agent to enhance their bundle forming property, which will lead to a high degree of thermal degradation at high temperatures.

In addition, in JP '725, a fiber bundle wound up on a bobbin has strong bundle forming property, but it has the disadvantage that if a constant tension is not applied all through the step of unwinding the fiber bundle, the forcibly twisted fiber bundle is twisted back in the untwisting direction to cause entanglement as a result of, for example, formation of local loops. There are no suggestions or descriptions either regarding the reduction in the amount of pyrolysates that may be generated at high temperatures.

According to an example described in JP '321, furthermore, it is presumed that permanent twists remain in the carbon fiber bundle obtained, but the maximum number of filaments per twisted fiber bundle is as small as 6,000 and, accordingly, the twisting may not sufficiently improve the bundle forming property. There are no suggestions or descriptions either regarding the reduction in the amount of pyrolysates that may be generated at high temperatures.

According to an example described in JP '761, furthermore, it is presumed that permanent twists remain in the carbon fiber bundle obtained, but the fineness of the single fibers present in the precursor fiber used is as small as 0.7 dtex and, accordingly, it has the disadvantage that the single fibers in the resulting carbon fiber bundle are also small in diameter, leading to easy fuzz generation when they come into contact with a guide or roller. There are no suggestions or descriptions either regarding the reduction in the amount of pyrolysates that may be generated at high temperatures.

Moreover, although the method of wetting a carbon fiber bundle with water to develop temporarily bundle forming property is easy to perform, it has the disadvantage that a drying step needs to be added to remove moisture and that if moisture cannot be removed, volatile substances may be generated at a high temperature.

As described above, although the conventional techniques is based on the idea of using a twisting technique for the purpose of making improvements in production processes for carbon fiber reinforced composite materials and/or final products thereof or improvements in production processes for carbon fiber bundles and/or mechanical properties thereof, there are no suggestions about a carbon fiber bundle that has strong bundle forming property as a fiber bundle, hardly generates thermal degradation products even during a molding step performed at a high temperature, and is suitable for high-performance, low-cost production of a carbon fiber reinforced composite material, and currently, as an important task for the future, it is necessary to develop a new carbon fiber bundle that meets needs in various fields including the production of housing for automobiles and electronic instruments which are likely to be in greater demand in the future.

SUMMARY

We provide a carbon fiber bundle that satisfies the following requirements: retaining a twist count of 2 turns/m or more when suspended with one end fixed and the other end free; having a single fiber diameter of 6.1 μm or more and a heat loss rate at 450° C. of 0.15% or less, and meeting formula (1) wherein $L_c$ is the crystallite size and $\pi_{002}$ is the orientation parameter of crystallites determined from bulk measurement of the entire fiber bundle:

$$\pi_{002}>4.0\times L_c+73.2 \quad (1).$$

Preferably, a carbon fiber bundle retains a twist count of 16 turns/m or more.

In addition, we provide a carbon fiber bundle that satisfies the following requirements: retaining a surface layer twist angle of 0.2° or more when suspended with one end fixed and the other end free; having a single fiber diameter of 6.1 μm or more and a heat loss rate at 450° C. of 0.15% or less, and meeting formula (1) wherein $L_c$ is the crystallite size and $\pi_{002}$ is the orientation parameter of crystallites determined from bulk measurement of the entire fiber bundle.

Preferably, the carbon fiber bundle retains a surface layer twist angle of 2.0° or more.

Preferably, the carbon fiber bundle has a strand elastic modulus of 200 GPa or more.

Preferably, the carbon fiber bundle has a strand elastic modulus of 240 GPa or more.

Preferably, the carbon fiber bundle has a filament number of 10,000 or more.

We also provide a method of producing a carbon fiber bundle having a single fiber diameter of 6.1 μm or more and a heat loss rate at a temperature of 450° C. of 0.15% or less, including steps of performing stabilization of a precursor fiber bundle for polyacrylonitrile based carbon fiber, pre-carbonization thereof, and carbonization thereof in this order, the twist count and tension of the fiber bundle being 2 turns/m or more and 1.5 mN/dtex or more, respectively, in the carbonization step.

We further provide a method of producing a carbon fiber bundle retaining a surface layer twist angle of 0.2° or more when suspended with one end fixed and the other end free and having a single fiber diameter of 6.1 μm or more and a heat loss rate at a temperature of 450° C. of 0.15% or less, including steps for performing stabilization of a precursor fiber bundle for polyacrylonitrile based carbon fiber, pre-carbonization thereof, and carbonization thereof in this order, the tension of the fiber bundle being 1.5 mN/dtex or more in the carbonization step.

Preferably, the method produces a carbon fiber bundle having a filament number of 10,000 or more in the carbonization step.

Since the carbon fiber bundle is high in handleability and high-order processability and low in the generation rate of thermal degradation products even when molded at a high temperature, it is possible to achieve simultaneously a reduction of process troubles and a decrease in the defect rate in the step of molding a carbon fiber reinforced composite material that involves molding operation at a high temperature, as well as and a reduction in cost attributed thereto and an improvement in mechanical properties.

DETAILED DESCRIPTION

In the carbon fiber bundle in a first example, a twist count of 2 turns/m or more may remain when suspended with one end fixed and the other end free. A fixed end means an appropriately selected portion of the fiber bundle that is fixed to prevent the fiber bundle from rotating about the length direction of the fiber bundle as axis and the fixation can be achieved by restraining the rotation of the fiber bundle using adhesive tape or the like. A free end refers to the end that is formed when a continuous fiber bundle is cut in the cross-sectional direction perpendicular to the length direction, and the fiber bundle is not fixed at this end and can rotate about its length direction as axis. The expression "a twist count remains when suspended with one end fixed and the other end free" means that the carbon fiber bundle has a semi-permanent twist. A semi-permanent twist means a twist that will persist unless an external force is applied. A semi-permanent twist persists without being untwisted after the carbon fiber bundle is held for 5 minutes in a state where one end is fixed while the other end is free as specified in Examples. We found that if a carbon fiber bundle has a semi-permanent twist, it has the effect of improving the handleability of the fiber bundle since the fiber bundle will tighten naturally instead of loosening. We also found that in a carbon fiber bundle having a semi-permanent twist, even if breakage at single fiber level, namely so-called fuzz, occurs during high-order processing of the carbon fiber bundle, such fuzz will be prevented from extending longer, thereby ensuring an enhanced high-order processability. This is because the root portion of the fuzz is enveloped by twisted fibers and works to prevent the fuzz from extending in the length direction of the fiber bundle. Furthermore, in common carbon fiber bundles that have no semi-permanent twists, but are forcibly twisted, the forcibly twisted bundles can join together to form higher order twists (so-called kinks or snarls) to allow them to be folded like a woven rope, unless a tension is applied constantly to the fiber bundles, whereas carbon fiber bundles having semi-permanent twists will serve as easily handleable carbon fiber bundles that are free of the formation of higher order twists regardless of the existence of tension. These findings suggest that if a fiber bundle suspended with one end fixed and the other end free retains a twist count of 2 turns/m or more without significant untwisting, it will have higher handleability and enhanced high-order processability. Although the remaining twist count is preferably as large as possible to realize strong bundle forming property, a twist count of about 500 turns/m is commonly the upper limit due to constraints associated with the twisting step in the production process. The remaining twist count is preferably 5 to 120 turns/m, more preferably 5 to 80 turns/m, still more preferably 16 to 80 turns/m, still more preferably 20 to 80 turns/m, still more preferably 31 to 80 turns/m, and particularly preferably 46 to 80 turns/m. A carbon fiber bundle that retains a twist count of 2 turns/m or more when suspended with one end fixed and the other end free can be produced by the method of producing the carbon fiber bundle described later. Specifically, the remaining twist count can be controlled by adjusting the twist count of the fiber bundle in the step for carbonization treatment. Although a detailed measurement method of the remaining twist count will be described later, an appropriately selected portion of a fiber bundle is firmly fixed with tape or the like to form a fixed end, and then the fiber bundle is cut at a position an appropriate distance away from the fixed end to form a free end. Subsequently, the fiber bundle is suspended so that the fixed end is at the uppermost position, and left stationary for 5 minutes, and then it is untwisted while holding the free end. The number of turns required for complete untwisting is counted and divided by the length to calculate the remaining twist count (per meter).

In the carbon fiber bundle in a second example, the surface layer of the fiber bundle may retain a twist angle of 0.2° or more when suspended with one end fixed and the other end free. These findings suggest that if a fiber bundle suspended with one end fixed and the other end free consequently retains a fiber bundle surface layer twist angle of 0.2° or more without undergoing significant untwisting, it will have higher handleability and enhanced high-order processability. Although the remaining fiber bundle surface layer twist angle is preferably as large as possible to realize strong bundle forming property, a fiber bundle surface layer twist angle of about 52.5° is commonly the upper limit due to constraints associated with the twisting step in the production process. The remaining fiber bundle surface layer twist angle is preferably 0.7° to 41.5°, more preferably 0.7° to 30.5°, still more preferably 2.0° to 30.5°, still more preferably 2.0 to 24.0°, and particularly preferably 2.5° to 12.5°. A carbon fiber bundle that retains a twist of 0.2° or more when suspended with one end fixed and the other end free can be produced according to the method of producing the carbon fiber bundle described later. Specifically, the remaining fiber bundle surface layer twist angle can be controlled by adjusting the twist count of the fiber bundle and also by adjusting the filament number and the single fiber diameter in the step of carbonization treatment. As the filament number of the carbon fiber bundle and the diameter of the single fibers increase, the twist angle can be increased largely if the twist count of the fiber bundle is kept constant, thus leading to a higher handleability and enhanced high-order processability. The remaining fiber bundle surface layer twist angle can be calculated from the twist count, the filament number of the carbon fiber bundle, and the diameter of the single fibers determined by the method described later.

For the carbon fiber bundle according to the first or second examples, the diameter of the single fibers contained in the carbon fiber bundle is 6.1 μm or more. Unless otherwise specified for either of the examples, all descriptions relate to features common to both the first and second examples. The diameter of the single fibers is preferably 6.5 μm or more, more preferably 6.9 μm or more, and still more preferably 7.1 μm or more. The diameter of the single fibers contained in a carbon fiber bundle referred to herein is a value calculated from the mass of the carbon fiber bundle, the number of single fibers contained in the carbon fiber bundle, and the density of the carbon fibers, and a detailed measurement method will be described later. We found that as the diameter of the single fibers increases, each single fiber increases in flexing resistance, and accordingly each fiber bundle, which is an aggregate of single fibers, increases in flexing resistance, which is advantageous for realizing stronger overall bundle forming property. The effect on bundle forming property and handleability can be enhanced to a required level if the diameter of the single fibers is 6.1 μm or more. Although there is no particular upper limit on the diameter of the single fibers, it is practically about 15 μm. The diameter of the single fibers can be controlled by adjusting the rate of discharge through the spinneret during the yarn making process of a precursor fiber bundle for polyacrylonitrile based carbon fiber and the total draw ratio in the process from the discharge through the spinneret until the completion of carbon fiber production.

The carbon fiber bundle has a heat loss rate at a temperature of 450° C. of 0.15% or less. Although a detailed measurement method for the heat loss rate at 450° C. will be described later, it refers to the rate of change in mass that occurs when a certain amount of the carbon fiber bundle being examined is weighed and then heated for 15 minutes in an inert gas atmosphere in an oven set at a temperature of 450° C. A carbon fiber bundle having a low heat loss rate under the above conditions is lower in the rate of generation of pyrolysates (decomposition gas and residue) when it is exposed to high temperature heat, and will not suffer from significant bubbling caused by the decomposition gas or significant adhesion of foreign substances resulting as residues from thermal degradation that may occur at the interface between the matrix resin and the carbon fiber in a molding step performed at high temperature. Therefore, even in a highly heat resistant matrix resin that requires a high temperature molding step or using a molding step that is required to be performed at a high temperature, it serves for easy production of a carbon fiber reinforced composite material characterized by an increased adhesive strength between the matrix resin and the carbon fiber. Major characteristics that can be estimated from the heat loss rate include those related to the use of a sizing agent, those related to the desorption of adsorbed moisture on the carbon fiber, and those related to vapors and pyrolysates of other surface deposits. In particular, since the heat loss rate is most strongly affected by the amount of the deposited sizing agent, the heat loss rate can be controlled by reducing the amount of the deposited sizing agent or eliminating the addition of the sizing agent. When the thermal stability of the carbon fiber bundle itself as a base material is low, the heat loss rate can be larger than 0.15% even when the amount of the deposited sizing agent is small. Therefore, although the heat loss rate is not a measure that reflects only the amount of the deposited sizing agent, a carbon fiber bundle having a low thermal stability as a base material is usually not industrially useful and, therefore, a heat loss rate of 0.15% or less is adopted simply as a criterion to judge its suitability. Conventionally, a certain amount of a sizing agent has been required to allow a carbon fiber bundle to develop bundle forming property, but the carbon fiber bundle, which has remaining twists, exhibits strong bundle forming property even when free of a sizing agent. The heat loss rate is preferably 0.10% or less, more preferably 0.07% or less, and still more preferably 0.05% or less.

The carbon fiber bundle meets formula (1), wherein $L_c$ is the crystallite size and $\pi_{002}$ is the orientation parameter of crystallites determined from bulk measurements of the entire fiber bundle:

$$\pi_{002} > 4.0 \times L_c + 73.2 \quad (1).$$

The crystallite size $L_c$ and the orientation parameter of crystallites $\pi_{002}$ are indicators of the thickness in the c-axis direction of the crystallites present in the carbon fiber and the orientation angle with respect to the fiber axis of the crystallites, which are determined from wide angle X-ray diffraction measurements. A detailed measuring procedure will be described later. In general, as the crystallite size $L_c$ increases, the adhesive strength between the carbon fiber and the matrix tends to decrease, and accordingly, increasing the orientation parameter of crystallites $\pi_{002}$ relative to the crystallite size $L_c$ makes it possible to enhance the elastic modulus of the resulting resin-impregnated strand effectively while suppressing the decrease in adhesive strength. If no tension is applied in the step for carbonization treatment, a carbon fiber bundle having local shapes similar to permanent twisting is sometimes obtained as a result of shrinking of the fiber bundle, but the carbon fiber bundle thus obtained tends to have a small orientation parameter of crystallites $\pi_{002}$ relative to the crystallite size $L_c$ and cannot be said to be industrially useful. A carbon fiber bundle that satisfies formula (1) serves for easy production of a carbon fiber reinforced composite material having an enhanced rigidity and can meet needs in industrial fields that are expected to grow in the future. For the carbon fiber bundle, the constant term in formula (1) is preferably 73.8 and more preferably 74.4. A method of producing a carbon fiber bundle that meets formula (1) will be described later.

The crystallite size $L_c$ is preferably 1.7 to 8 nm, more preferably 1.7 to 3.8 nm, still more preferably 2.0 to 3.2 nm, and particularly preferably 2.3 to 3.0 nm. A large crystallite size $L_c$ serves to realize effective stress bearing inside the carbon fiber to permit easy enhancement of the strand elastic modulus, but if the crystallite size $L_c$ is too large, stress concentration can occur to cause a decrease in the strand strength, compressive strength or the like and, therefore, an appropriate value should be determined on the basis of the balance among the required strand elastic modulus, strand strength, and compressive strength. The crystallite size $L_c$ can be controlled mainly by changing the treatment periods and maximum temperatures in and after the carbonization step.

Furthermore, the orientation parameter of crystallites $\pi_{002}$ is preferably 80% to 95%, more preferably 80% to 90%, and still more preferably 82% to 90%. A higher orientation parameter of crystallites $\pi_{002}$ ensures a higher stress bearing ability in the fiber axial direction, allowing easy enhancement of the strand elastic modulus. Although the orientation parameter of crystallites $\pi_{002}$ can be controlled by changing the stretching tension in addition to the temperature and time period of the step for carbonization treatment, an excessively increased stretching tension in the step for carbonization treatment can increase the frequency of fiber breakage to allow the fiber bundle to be caught by a roller or cause the breakage of the entire fiber bundle to disable the process, suggesting that there is a limit to the stretching tension that can be adopted in the conventional methods for producing carbon fiber bundles. On the other hand, the preferred production method described later allows a high stretching tension to be applied while preventing fiber breakage.

The carbon fiber bundle preferably gives a strand elastic modulus of 200 Gpa or more. A higher strand elastic modulus allows the carbon fiber to serve effectively for reinforcement in the resulting carbon fiber reinforced composite material, thus making it possible to allow the carbon fiber reinforced composite material to have a high rigidity. If no tension is applied in the step for carbonization treatment, a carbon fiber bundle having local shapes similar to permanent twisting is sometimes obtained as a result of shrinking of the fiber bundle, but the carbon fiber bundle thus obtained tends to have a small strand elastic modulus and cannot be said to be industrially useful. A strand elastic modulus of 200 GPa or more serves for easy production of a carbon fiber reinforced composite material having an enhanced rigidity and can meet needs in industrial fields that are expected to grow in the future. The strand elastic modulus is preferably 240 GPa or more, more preferably 260 GPa or more, still more preferably 280 GPa or more, and still more preferably 350 GPa or more. The strand modulus can be measured according to the tensile test of resin-impregnated strands described in JIS R7608 (2004). When the carbon fiber bundle under test has a twist, it is untwisted by the same number of turns as the original twist, and the untwisted specimen is used for measurement. The strand elastic modulus can be controlled by a generally known method such as changing the tension or maximum temperature during the carbonization treatment.

For the carbon fiber bundle, the filament number is preferably 10,000 or more and more preferably 20,000 or more. If assuming fiber bundles that have the same twist count, the distance between the central axis of twists and the outer periphery in each fiber bundle is larger in a fiber bundle having a larger filament number, thereby ensuring stabler twists, higher handleability, and enhanced high-order processability. As another effect, furthermore, it will be easier to control fuzz generation and fiber breakage in the carbonization step even when applying a high tension, thus effectively making it possible to enhance the strand elastic modulus. The filament number can be calculated from the density and metsuke of the fiber bundle and the average diameter of the single fibers. Although there is no particular limitation on the upper limit on the filament number and it may be set appropriately depending on the intended use, the upper limit is generally about 250,000 in view of requirements of the production process to provide carbon fiber.

The method of producing the carbon fiber bundle is described below.

A precursor fiber bundle for polyacrylonitrile based carbon fiber that serves as material for producing the carbon fiber bundle can be prepared by spinning a spinning solution of a polyacrylonitrile copolymer.

Examples of the polyacrylonitrile copolymer include not only homopolymers produced only from acrylonitrile, but also copolymers produced from a combination of an acrylonitrile adopted as main component and another monomer, and mixtures thereof. More specifically, the polyacrylonitrile copolymer preferably contains 90% to 100% by mass of a structure derived from acrylonitrile and less than 10% by mass of a structure derived from a copolymerizable monomer.

Useful monomers that are copolymerizable with acrylonitrile include, for example, acrylic acid, methacrylic acid, itaconic acid, and alkali metal salts thereof ammonium salts and lower alkyl esters; acrylamide and derivatives thereof and allyl sulfonic acid, methacrylic sulfonic acid, and salts or alkyl esters thereof.

The polyacrylonitrile copolymer described above is dissolved in a solvent in which the polyacrylonitrile copolymer is soluble, such as dimethyl sulfoxide, dimethylformamide, dimethylacetamide, nitric acid, aqueous zinc chloride solution, and aqueous sodium rhodanide solution, to prepare a spinning solution. If the solution polymerization technique is used to produce the polyacrylonitrile copolymer, it is preferable that the solvent used for polymerization is the same as the solvent used for spinning because in that instance, it is possible to eliminate steps for separating the resulting polyacrylonitrile copolymer and redissolving it in a solvent to use for spinning.

A precursor fiber bundle for polyacrylonitrile based carbon fiber can be produced by spinning the spinning solution prepared as described above by the wet spinning method or the dry-jet wet spinning method. In particular, the dry jet wet spinning method is preferred to allow the aforementioned polyacrylonitrile copolymer having a specific molecular weight to exhibit its good characteristics.

A precursor fiber bundle for polyacrylonitrile based carbon fiber can be produced by introducing the spinning solution prepared as described above into a coagulation bath in which it is coagulated, and subjecting the resulting coagulated fiber bundle to a water washing step, an in-bath stretching step, an oil agent treatment step, and a drying step. The water washing step may be omitted so that the coagulated fiber bundles are subjected directly to the in-bath stretching step, or the in-bath stretching step may be performed after removing the solvent by the water washing step. In general, it is preferable for the in-bath stretching step to be carried out in a single or a plurality of stretching baths controlled at a temperature of 30° C. to 98° C. Furthermore, a dry heat stretching step or a steam stretching step may be added to the above steps.

It is preferable for the single fibers contained in the precursor fiber bundles for polyacrylonitrile based carbon fiber to have an average fineness of 0.8 dtex or more, more preferably 0.9 dtex or more, still more preferably 1.0 dtex or more, and particularly preferably 1.1 dtex or more. If the single fibers in the precursor fiber bundle for polyacrylonitrile based carbon fiber have an average fineness of 0.8 dtex or more, the resulting carbon fiber bundle will have a high single fiber fineness, thus permitting easy production of a carbon fiber bundle having an enhanced bundle forming property. If the average fineness of the single fibers in the precursor fiber bundle for polyacrylonitrile based carbon fiber is too high, it will sometimes be difficult to perform uniform treatment in the undermentioned stabilization step, possibly leading to an unstable manufacturing process or resulting in a carbon fiber bundle with deteriorated mechanical characteristics. From this point of view, the average fineness of the single fibers in the precursor fiber bundle is preferably 2.0 dtex or less. The average fineness of the single fibers in the precursor fiber bundle for polyacrylonitrile based carbon fiber can be controlled by a generally known method such as adjusting the discharge rate of the spinning solution from the spinneret or the stretching ratio.

The resulting precursor fiber bundle for polyacrylonitrile based carbon fiber is usually in the form of continuous fibers. It is preferable for the filament number of the fiber bundle to be 1,000 or more. As the filament number increases, the productivity can be enhanced more easily. When the filament number of the precursor fiber bundle for polyacrylonitrile based carbon fiber is smaller than the preferable filament number for the final carbon fiber bundle, a plurality of fiber bundles may be gathered before performing the stabilization step to realize a preferable filament number for the final carbon fiber bundle. Instead, stabilized fiber bundles may be prepared first by the undermentioned method and then gathered before performing the pre-carbonization step, or pre-carbonized fiber bundles may be prepared first by the undermentioned method and then gathered before performing the carbonization step. Although there is no clear upper limit on the filament number in the precursor fiber bundles for polyacrylonitrile based carbon fiber, it is commonly about 250,000.

The carbon fiber bundle can be prepared by stabilizing the aforementioned precursor fiber bundle for polyacrylonitrile based carbon fiber and then subjecting it to pre-carbonization treatment and carbonization treatment in this order. It is noted that the steps of performing these treatments will be occasionally referred to as the stabilization step, pre-carbonization step, and carbonization step.

The stabilization of the precursor fiber bundle for polyacrylonitrile based carbon fiber is preferably performed in an air atmosphere at a temperature of 200° C. to 300° C.

The stabilization step is followed by the pre-carbonization step. In the pre-carbonization step, it is preferable for the resulting stabilized fiber bundle to be subjected to heat treatment in an inactive atmosphere at or below a maximum temperature of 500° C. to 1,000° C. until the density reaches 1.5 to 1.8 g/cm$^3$.

Furthermore, the pre-carbonization step described above is followed by the carbonization step. In the carbonization step, it is preferable for the resulting pre-carbonized fiber bundle to be subjected to heat treatment in an inactive atmosphere at or below a maximum temperature of 1,000° C. to 3,000° C. The maximum temperature in the carbonization step is preferably as high as possible from the viewpoint of obtaining a carbon fiber bundle having a high strand elastic modulus, but since an excessively high temperature can result in a decrease in the strength of adhesion between the carbon fiber and the matrix, it is preferable to set an appropriate temperature on the basis of this trade-off relation. For the above reason, the maximum temperature in the carbonization step is more preferably 1,400° C. to 2,500° C. and still more preferably 1,700° C. to 2,000° C.

For the carbon fiber bundle production method according to the first example, the fiber bundle being treated in the carbonization step has a twist count of 2 turns/m or more. The twist count is preferably 5 to 120 turns/m, more preferably 5 to 80 turns/m, still more preferably 16 to 80 turns/m, still more preferably 20 to 80 turns/m, still more preferably 31 to 80 turns/m, and particularly preferably 46 to 80 turns/m. Controlling the twist count in the above range produces a carbon fiber bundle having a specific degree of permanent twist and accordingly, the carbon fiber bundle will have a strong bundle forming property, high carbon fiber bundle handleability, and enhanced high-order processability. Although there is no particular limitation on the upper limit on the twist count, it is preferable to set a temporary upper limit to about 500 turns/m to avoid complication of the twisting step. The twist count can be controlled by a method in which the precursor fiber bundle, stabilized fiber bundle, or pre-carbonized fiber bundle is once wound up on a bobbin, followed by unwinding the fiber bundle while rotating the bobbin in the plane perpendicular to the unwinding direction, or by a method in which, instead of winding up the traveling fiber bundle on a bobbin, a rotating roller or belt is brought into contact with it to impart a twist.

For the carbon fiber bundle production method according to the second example, the carbon fiber bundle resulting from the carbonization step retains a surface layer twist angle of 0.2° or more when suspended with one end fixed and the other end free. This twist angle is preferably 0.7° to 41.5°, more preferably 0.7° to 30.5°, still more preferably 2.0° to 30.5°, still more preferably 2.0 to 24.0°, and particularly preferably 2.5° to 12.5°. Useful methods of controlling the twist angle in the above range include adjusting the twist count of the fiber bundle in the carbonization step and also by adjusting the filament number and the single fiber diameter appropriately in the carbonization step. Controlling the twist angle in the above range serves to produce a carbon fiber bundle having a specific degree of permanent twist and accordingly, the carbon fiber bundle will have a strong bundle forming property, high carbon fiber bundle handleability, and enhanced mechanical characteristics. Although there is no particular limitation on the upper limit of the twist angle, it is preferable to set a temporary upper limit to about 52.5° to avoid complication of the twisting step. The twist angle can be controlled by a method in which the precursor fiber bundle for polyacrylonitrile based carbon fiber, stabilized fiber bundle, or pre-carbonized fiber bundle is once wound up on a bobbin, followed by unwinding the fiber bundle while rotating the bobbin in the plane perpendicular to the unwinding direction, or by a method in which, instead of winding up the traveling fiber bundle on a bobbin, a rotating roller or belt is brought into contact with it to impart a twist.

The tension in the carbonization step is 1.5 mN/dtex or more. This tension is preferably 1.5 to 18 mN/dtex, more preferably 3 to 18 mN/dtex, and still more preferably 5 to 18 mN/dtex. The tension in the carbonization step is calculated by dividing the tension (mN) measured at the outlet of the carbonization furnace by the total fineness (dtex), which is the product of the average fineness (dtex) of the single fibers and the filament number in the precursor fiber bundle for polyacrylonitrile based carbon fiber used here. By controlling the tension, it is possible to control the orientation parameter of crystallites $\pi_{002}$ (s) to produce a carbon fiber bundle that meets formula (1) without significantly affecting the crystallite size $L_c$ of the resulting carbon fiber bundle. The tension is preferably as high as possible from the viewpoint of providing a carbon fiber bundle having a high strand elastic modulus, but an excessively high tension can lead to a decrease in processability or resulting in a carbon fiber having poor quality and, therefore, both of them should be taken into account when setting it. If the tension in the carbonization step is increased without imparting twists, breakage of single fibers can occur in the fiber bundle and fuzz formation can be accelerated to cause a decrease in the processability in the carbonization step or breakage of the entire fiber bundle, possibly leading to a failure in maintaining a required tension, whereas if the fiber bundle is twisted in the carbonization step, fuzz formation is suppressed to ensure a high tension.

The filament number of the fiber bundle during the carbonization treatment may be equal to or different from the filament number of the final carbon fiber bundle. If the filament number of the fiber bundle in the carbonization step is smaller than the filament number of the final carbon fiber bundle, a plurality of such bundles may be gathered after the carbonization treatment, whereas if it is larger than the filament number of the final carbon fiber bundle, it may be divided after the carbonization step. When the bundle is divided after the carbonization step, the fiber bundle being treat in the carbonization step may be in the form of a plurality of combined twisted fiber bundles or in the form of a plurality of combined bunches each composed of combined twisted fiber bundles to ensure an easy dividing operation. Although there is no particular limitation on the upper limit on the filament number in the carbonization step and it may be set appropriately depending on the intended use, the upper limit is generally about 250,000 in view of requirements of the production process to provide carbon fiber.

Good examples of the inert gas used for the inert atmosphere include nitrogen, argon, and xenon, of which nitrogen is preferred from an economic point of view.

The carbon fiber bundle obtained as described above may be subjected to surface treatment to introduce a functional group containing an oxygen atom, thereby ensuring an improved adhesive strength between the carbon fiber and the matrix resin. Useful surface treatment methods to be used include gas phase oxidization, liquid phase oxidization, and liquid phase electrolytic oxidization, of which liquid phase electrolytic oxidization has been preferred from the viewpoint of high productivity and uniform treatment. There are no specific limitations on the technique to be used for liquid phase electrolytic oxidation and a generally known one may be selected appropriately.

After such electrolytic treatment, a sizing agent may be attached to the resulting carbon fiber bundle to further enhance the handleability and higher order processability or ensure improved adhesive strength between the carbon fiber and the matrix resin. It is preferable to reduce the amount of the deposited sizing agent as largely as possible, and the amount is preferably 0.1% or less. The amount of the deposited sizing adhesion is more preferably 0.05% or less, and still more preferably the sizing step is omitted. A smaller amount of the deposited sizing agent leads to a smaller volume of gas generation from thermal degradation of the sizing agent in a molding step performed at a high temperature, making it possible to maintain a stronger adhesive strength between the carbon fiber and the matrix resin. Commonly, a certain amount of a sizing agent is required to allow a carbon fiber bundle to develop bundle forming property, but the carbon fiber bundle, which has remaining twists, exhibits strong bundle forming property even when nearly or completely free of a sizing agent.

The methods used to measure the various physical values mentioned herein are described below.

Twist Count Remaining After Suspension with One End Fixed and the Other End Free A guide bar is installed at a position with a height of 60 cm from a horizontal plane, and an appropriately selected portion of the carbon fiber bundle is taped to the guide bar to serve as a fixed end, and then the carbon fiber bundle is cut at a position 50 cm away from the fixed end to form a free end. The free end is enclosed by sandwiching between pieces of tape so that it will not be divided into single fibers. To eliminate those components of the twist that are not semi-permanent but temporal or capable of untwisting over time, the specimen is left to stand in this state for 5 minutes and then the free end is rotated while counting the number of turns until the specimen is completely untwisted, followed by recording the total number of turns n (turns). The remaining twist count is calculated by the following formula. Three measurement are taken by the above procedure and their average is adopted to represent the remaining twist count:

$$\text{Remaining twist count (turns/m)} = n\text{(turns)}/0.5\text{ (m)}.$$

Diameter of Single Fibers Contained in Carbon Fiber Bundle

The mass per unit length of the carbon fiber bundle (g/m) is divided by the density (g/m$^3$) and further divided by the filament number. The diameter of a single fiber is expressed in

Density of Carbon Fiber Bundle

A 1 m specimen is sampled from the carbon fiber bundle to be examined and measurements are taken by the Archimedes method using o-dichloroethylene as specific gravity liquid. Three measurements are taken for a test.

Heat Loss Rate at 450° C.

The carbon fiber bundle to be examined is cut to a mass of 2.5 g±0.2 g, wound and used to prepare a hank having a diameter of about 3 cm, followed by weighing it to give a mass $w_0$ (g) before heat treatment. Then, it is heated in a nitrogen atmosphere in an oven at a temperature of 450° C. for 15 minutes and allowed to cool to room temperature in a desiccator, followed by weighing it to give a mass $w_1$ (g) after heat treatment. The heat loss rate at 450° C. is calculated by the following formula. Three measurements are taken and their average is adopted:

$$\text{Heating loss rate (\%) at 450° C.} = (w_0 - w_1)/w_0 \times 100 \ (\%).$$

Strand Strength and Strand Elastic Modulus of Carbon Fiber Bundle

The strand strength and strand elastic modulus of a carbon fiber bundle are determined by the following procedure according to the resin-impregnated strand test method specified in JIS R7608 (2004). When the carbon fiber bundle has a twist, it is untwisted by the same number of turns as the original twist, and the untwisted specimen is used for measurement. A resin consisting of Celoxide (registered trademark) 2021P (manufactured by Daicel Chemical Industries, Ltd.), boron trifluoride monoethylamine (manufactured by Tokyo Chemical Industry Co., Ltd.), and acetone, mixed at a ratio of 100/3/4 (parts by mass) was used under the curing conditions of atmospheric pressure, a temperature of 125° C., and a curing time of 30 minutes. Ten strands of the carbon fiber bundle were examined and the average measurements are taken to represent its strand strength and strand elastic modulus. The strain range for calculating the strand elastic modulus is set to 0.1% to 0.6%.

Crystallite Size $L_c$ and Orientation Parameter of Crystallites $\pi_{002}$ of Carbon Fiber Bundle The constituent fibers of the carbon fiber bundle are paralleled and hardened using a collodion alcohol solution to prepare a quadrangular prism specimen with a height of 4 cm and a side length of 1 mm. The specimen prepared above is examined under the following conditions using a wide-angle X-ray diffraction apparatus.

1. Measurement of Crystallite Size $L_c$

X-ray source: CuKα beam (tube voltage 40 kV, tube current 30 mA)

Detector: goniometer+monochromator+scintillation counter

Scanning range: 2θ=10° to 40°

Scanning mode: step scan, step 0.02°, counting time 2 sec.

A peak appearing in the vicinity of 2θ=25° to 26° is identified in the diffractive pattern obtained and its half-width is determined, from which the crystallite size is calculated by the following Scherrer equation:

$$\text{Crystallite size (nm)} = K\lambda/\beta_0 \cos\theta_B$$

wherein

K: 1.0, λ: 0.15418 nm (wavelength of X-ray)

$\beta_0$: $(\beta_E^2 - \beta_1^2)^{1/2}$ $\beta_E$: apparent half-width (measured) rad, $\beta_1$: $1.046\times10^{-2}$ rad $\theta_B$: Bragg's diffraction angle.

2. Measurement of Orientation Parameter of Crystallites $\pi_{002}$

This is calculated by the following equation from the half-width of the intensity distribution determined by scanning the aforementioned crystal peak in the azimuthal direction:

$$\pi_{002} = (180 - H)/180$$

wherein

H: apparent half-width (deg).

Three measurements are taken by the above procedure, and their arithmetic averages are adopted as the crystallite size and orientation parameter of crystallites of the carbon fiber.

In the Examples and Comparative Examples described later, a XRD-6100 wide-angle X-ray diffractometer manufactured by Shimadzu Corporation was used.

Bundle Forming Property of Carbon Fiber Bundle

The carbon fiber bundle to be evaluated is held by the right hand and the left hand at two positions 30 cm apart from each other in the fiber axial direction. After the right and left hands is brought closer to each other to a distance of 20 cm, both hands are moved up and down multiple times in the vertical direction while visually observing the state of the fiber bundle. To keep the portions held by the right and left hands at the same vertical height, both hands are moved vertically in the same manner. The range of the vertical movement is 10 cm and the movement is repeated 20 times at a frequency of one up-and-down movement per second. At this time, the bundle forming property is rated as "bad" if the fiber bundle fans after unraveling into single fibers. Although an accurate rating is difficult because of being a sensory evaluation, the fiber bundle is regarded as fanning in the form of single fibers if its width increased to 5 cm or more in the direction perpendicular to the fiber axis at any position on it. When not 5 cm or more, it is rated as "good" for bundle forming property. The evaluation should be performed in a room with as little wind as possible, and the central portion of the fiber bundle should be suspended by gravity.

Twist Angle of Fiber Bundle Surface Layer Remaining After Suspension with One End Fixed and the Other End Free After calculating the overall diameter (μm) of the fiber bundle from the diameter (μm) and the filament number of the aforementioned single fibers by one of the following formulae, the remaining twist angle (°) of the fiber bundle surface layer is calculated by the other following formula using the remaining twist count (turn/m):

$$\text{Overall diameter of fiber bundle (μm)} = \{(\text{diameter of single fiber})^2 \times \text{filament number}\}^{0.5}$$

$$\text{Remaining twist angle (°) of surface layer of fiber bundle} = \text{atan}\,(\text{overall diameter of fiber bundle} \times 10^{-6} \times \pi \times \text{number of remaining twist count}).$$

Number of Single Fiber Breakage Points

The number of single fiber breakage points in a carbon fiber bundle is determined as described below. The outer surface of a 3.0 m portion of a carbonized carbon fiber bundle having a remaining twist is observed to count the number of points where a single fiber is broken. Three measurement runs are performed and the number of carbon fiber breakage points, which is defined by the following equation, is calculated from the total number of such points found in the three measurement runs:

Number of carbon fiber breakage points (number/m)
=total number of single fiber breakage points found in three measurement runs/3.0/3.

EXAMPLES

Examples 1 to 20 and Comparative Examples 1 to 7 were performed by the procedure described in the following Comprehensive Example under the conditions described in Table 1.

Comprehensive Example

A monomer composition containing 99% by mass of acrylonitrile and 1% by mass of itaconic acid was polymerized by the solution polymerization method using dimethyl sulfoxide as solvent to prepare a spinning solution containing a polyacrylonitrile copolymer. The resulting spinning solution was subjected to a dry-jet wet spinning process in which it is filtered first, discharged in air through a spinneret, and then introduced into a coagulation bath containing an aqueous solution of dimethyl sulfoxide to produce a coagulated fiber bundle. Then, the coagulated fiber bundle was washed with water, stretched at a stretching ratio of 3 in a hot water bath at 90° C., treated with a silicone oil agent, dried by using a roller heated at a temperature of 160° C., and subjected to pressurized steam stretching at a stretching ratio of 4 to provide a precursor fiber bundle for polyacrylonitrile based carbon fiber having a single fiber fineness of 1.1 dtex. Subsequently, four such precursor fiber bundles for polyacrylonitrile based carbon fiber as prepared above were gathered so that the total number of single fibers would be 12,000, and heat-treated in an oven filled with air at a temperature of 230° C. to 280° C. while maintaining a stretching ratio of 1 to achieve its conversion into a stabilized fiber bundle.

Example 1

After producing a stabilized fiber bundle by the procedure described in the comprehensive example, the resulting stabilized fiber bundle was subjected to a twisting step to impart a twist of 5 turns/m and subjected to a pre-carbonization step at a stretching ratio of 0.97 in a nitrogen atmosphere at a temperature of 300° C. to 800° C., thereby providing a pre-carbonized fiber bundle. Then, the pre-carbonized fiber bundle was subjected to carbonization treatment under the conditions shown in Table 1 to provide a carbon fiber bundle without performing treatment with a sizing agent. The processability in the carbonization step was high, and the number of single fiber breakage points in the resulting carbon fiber bundle was small, indicating good quality. Evaluation results of the carbon fiber bundle obtained are given in Table 1.

Example 2

Except that the twist count was 20 turns/m, the same procedure as in Example 1 was carried out to prepare a carbon fiber bundle. The processability in the carbonization step was high, and the number of single fiber breakage points in the resulting carbon fiber bundle was small, indicating good quality. Evaluation results of the carbon fiber bundle obtained are given in Table 1.

Example 3

Except that the twist count was 50 turns/m, the same procedure as in Example 1 was carried out to prepare a carbon fiber bundle. The processability in the carbonization step was high, and the number of single fiber breakage points in the resulting carbon fiber bundle was small, indicating good quality. Evaluation results of the carbon fiber bundle obtained are given in Table 1.

Example 4

Except that the twist count was 75 turns/m, the same procedure as in Example 1 was carried out to prepare a carbon fiber bundle. The processability in the carbonization step was high, and the number of single fiber breakage points in the resulting carbon fiber bundle was small, indicating good quality. Evaluation results of the carbon fiber bundle obtained are given in Table 1.

Example 5

Except that the twist count was 100 turns/m, the same procedure as in Example 1 was carried out to prepare a carbon fiber bundle. The processability in the carbonization step was high, and the number of single fiber breakage points in the resulting carbon fiber bundle was small, indicating good quality. Evaluation results of the carbon fiber bundle obtained are given in Table 1.

Example 6

Except that the maximum temperature in the carbonization step was 1,900° C., that the twist count was 10 turns/m, and that the tension in the carbonization step was 3.5 mN/dtex, the same procedure as in Example 1 was carried out to produce a carbon fiber bundle. The processability in the carbonization step was high, and the number of single fiber breakage points in the resulting carbon fiber bundle was small, indicating good quality. Evaluation results of the carbon fiber bundle obtained are given in Table 1.

Example 7

Except that the twist count was 50 turns/m and that the tension in the carbonization step was 10.2 mN/dtex, the same procedure as in Example 6 was carried out to produce a carbon fiber bundle. The processability in the carbonization step was high, and the number of single fiber breakage points in the resulting carbon fiber bundle was small, indicating good quality. Evaluation results of the carbon fiber bundle obtained are given in Table 1.

Example 8

Except that the twist count was 75 turns/m and that the tension in the carbonization step was 6.1 mN/dtex, the same procedure as in Example 6 was carried out to produce a carbon fiber bundle. The processability in the carbonization step was high, and the number of single fiber breakage points in the resulting carbon fiber bundle was small, indicating good quality. Evaluation results of the carbon fiber bundle obtained are given in Table 1.

Example 9

Except that the twist count was 100 turns/m and that the tension in the carbonization step was 5.4 mN/dtex, the same procedure as in Example 6 was carried out to produce a carbon fiber bundle. The processability in the carbonization step was high, and the number of single fiber breakage points in the resulting carbon fiber bundle was small, indicating good quality. Evaluation results of the carbon fiber bundle obtained are given in Table 1.

Example 10

Except that the twist count was 5 turns/m, the same procedure as in Example 7 was carried out to prepare a carbon fiber bundle. The processability in the carbonization step decreased, and the number of single fiber breakage points in the resulting carbon fiber bundle increased, indicating deteriorated quality. Evaluation results of the carbon fiber bundle obtained are given in Table 1.

Example 11

Except that the twist count was 10 turns/m, the same procedure as in Example 7 was carried out to prepare a carbon fiber bundle. The processability in the carbonization step slightly decreased, and the number of single fiber breakage points in the resulting carbon fiber bundle slightly increased, indicating deteriorated quality. Evaluation results of the carbon fiber bundle obtained are given in Table 1.

Example 12

Except for performing the carbonization treatment at a maximum temperature of 1,400° C., the same procedure as in Example 6 was carried out to produce a carbon fiber bundle. The processability in the carbonization step was high, and the number of single fiber breakage points in the resulting carbon fiber bundle was small, indicating good quality. Evaluation results of the carbon fiber bundle obtained are given in Table 1.

Example 13

Except that the twist count was 50 turns/m and that the tension in the carbonization step was 7.8 mN/dtex, the same procedure as in Example 12 was carried out to produce a carbon fiber bundle. The processability in the carbonization step was high, and the number of single fiber breakage points in the resulting carbon fiber bundle was small, indicating good quality. Evaluation results of the carbon fiber bundle obtained are given in Table 1.

Example 14

Except that the twist count was 100 turns/m and that the tension in the carbonization step was 6.9 mN/dtex, the same procedure as in Example 12 was carried out to produce a carbon fiber bundle. The processability in the carbonization step was high, and the number of single fiber breakage points in the resulting carbon fiber bundle was small, indicating good quality. Evaluation results of the carbon fiber bundle obtained are given in Table 1.

Example 15

Except that the procedure in the comprehensive example was modified so that eight precursor fiber bundles were gathered, that the number of single fibers was 24,000, and that the tension in the carbonization step was 4.4 mN/dtex, the same procedure as in Example 7 was carried out to produce a carbon fiber bundle. The processability in the carbonization step was high, and the number of single fiber breakage points in the resulting carbon fiber bundle was small, indicating good quality. Evaluation results of the carbon fiber bundle obtained are given in Table 1.

Example 16

Except that the twist count was 75 turns/m and that the tension in the carbonization step was 3.0 mN/dtex, the same procedure as in Example 15 was carried out to produce a carbon fiber bundle. The processability in the carbonization step was high, and the number of single fiber breakage points in the resulting carbon fiber bundle was small, indicating good quality. Evaluation results of the carbon fiber bundle obtained are given in Table 1.

Example 17

Except that the twist count was 100 turns/m and that the tension in the carbonization step was 5.0 mN/dtex, the same procedure as in Example 15 was carried out to produce a carbon fiber bundle. The processability in the carbonization step was high, and the number of single fiber breakage points in the resulting carbon fiber bundle was small, indicating good quality. Evaluation results of the carbon fiber bundle obtained are given in Table 1.

Example 18

Except that the twist count was 8 turns/m and that the tension in the carbonization step was 10.2 mN/dtex, the same procedure as in Example 15 was carried out to produce a carbon fiber bundle. The processability in the carbonization step decreased, and the number of single fiber breakage points in the resulting carbon fiber bundle increased, indicating deteriorated quality. Evaluation results of the carbon fiber bundle obtained are given in Table 1.

Example 19

Except that the twist count was 35 turns/m and that the tension in the carbonization step was 10.2 mN/dtex, the same procedure as in Example 15 was carried out to produce a carbon fiber bundle. The processability in the carbonization step was high, and the number of single fiber breakage points in the resulting carbon fiber bundle was small, indicating good quality. Evaluation results of the carbon fiber bundle obtained are given in Table 1.

Example 20

Except that the twist count was 45 turns/m and that the tension in the carbonization step was 10.2 mN/dtex, the same procedure as in Example 15 was carried out to produce a carbon fiber bundle. The processability in the carbonization step was high, and the number of single fiber breakage points in the resulting carbon fiber bundle was small, indicating good quality. Evaluation results of the carbon fiber bundle obtained are given in Table 1.

Comparative Example 1

Except that the twist count was 0 turn/m and that the tension in the carbonization step was 7.5 mN/dtex, the same procedure as in Example 6 was carried out to produce a carbon fiber bundle. Fibers were frequently caught on the roller in the carbonization step, and the number of single fiber breakage points in the resulting carbon fiber bundle was large, indicating poor quality. Evaluation results of the carbon fiber bundle obtained are given in Table 1.

Comparative Example 2

Except that the tension in the carbonization step was 10.2 mN/dtex, the same procedure as Comparative example 1 was carried out to produce a carbon fiber bundle. Fibers were frequently caught on the roller in the carbonization step, making it impossible to produce a carbon fiber bundle. Evaluation results are given in Table 1.

Comparative Example 3

Except that the maximum temperature in the carbonization step was 1,400° C. and that the tension in the carbonization step was 5.4 mN/dtex, the same procedure as Comparative example 1 was carried out to produce a carbon fiber bundle. Fibers were frequently caught on the roller in the carbonization step, and the number of single fiber breakage points in the resulting carbon fiber bundle was large, indicating poor quality. Evaluation results of the carbon fiber bundle obtained are given in Table 1.

Comparative Example 4

Except that the twist count was 2 turns/m and that the tension in the carbonization step was 2.1 mN/dtex, the same procedure as Comparative example 3 was carried out to produce a carbon fiber bundle, which was then treated with a sizing agent. The processability in the carbonization step was high, and the number of single fiber breakage points in the resulting carbon fiber bundle was small, indicating good quality. Evaluation results of the carbon fiber bundle obtained are given in Table 1. Prior to performing the evaluation for the handleability of the fiber bundle, the twist count measured with one end left free, and the number of maximums and the helical pitch of the fiber bundle, the carbon fiber bundle was subjected twice to the procedure of immersing it in toluene at room temperature for 1 hour and immersing it in acetone at room temperature for 1 hour, and then it was dried in air in a cold, dark, substantially windless place for 24 hours or more.

Comparative Example 5

Except that the twist count was 1 turn/m and that the tension in the carbonization step was 1.5 mN/dtex, the same procedure as Comparative example 1 was carried out to produce a carbon fiber bundle, which was then coated with a sizing agent. The processability in the carbonization step was high, and the number of single fiber breakage points in the resulting carbon fiber bundle was small, indicating good quality. Evaluation results of the carbon fiber bundle obtained are given in Table 1. Prior to performing the evaluation for the handleability of the fiber bundle, the twist count measured with one end left free, and the number of maximums and the helical pitch of the fiber bundle, the carbon fiber bundle was subjected twice to the procedure of immersing it in toluene at room temperature for 1 hour and immersing it in acetone at room temperature for 1 hour, and then it was dried in air in a cold, dark, substantially windless place for 24 hours or more.

Comparative Example 6

Except that the twist count was 0 turn/m and that the tension in the carbonization step was 2.1 mN/dtex, the same procedure as Comparative example 5 was carried out to produce a carbon fiber bundle, which was then coated with a sizing agent. The processability in the carbonization step was high, and the number of single fiber breakage points in the resulting carbon fiber bundle was small, indicating good quality. Evaluation results of the carbon fiber bundle obtained are given in Table 1. Prior to performing the evaluation for the handleability of the fiber bundle, the twist count measured with one end left free, and the number of maximums and the helical pitch of the fiber bundle, the carbon fiber bundle was subjected twice to the procedure of immersing it in toluene at room temperature for 1 hour and immersing it in acetone at room temperature for 1 hour, and then it was dried in air in a cold, dark, substantially windless place for 24 hours or more.

Comparative Example 7

Except that the procedure in the comprehensive example was modified so that the precursor fiber bundle had a single fiber fineness of 0.8 dtex, that the twist count was 45 turns/m, and that the tension in the carbonization step was 10.3 mN/dtex, the same procedure as in Example 1 was carried out to produce a carbon fiber bundle, which was then coated with a sizing agent. Fuzz was frequently caught on the roller in the carbonization treatment of step, and the number of single fiber breakage points in the resulting carbon fiber bundle was large, indicating poor quality. Evaluation results of the carbon fiber bundle obtained are given in Table 1. Prior to performing the evaluation for the handleability of the fiber bundle, the twist count measured with one end left free, and the number of maximums and the helical pitch of the fiber bundle, the carbon fiber bundle was subjected twice to the procedure of immersing it in toluene at room temperature for 1 hour and immersing it in acetone at room temperature for 1 hour, and then it was dried in air in a cold, dark, substantially windless place for 24 hours or more.

Reference Example 1

Evaluation results of a carbon fiber bundle of Torayca (registered trademark) T700S (manufactured by Toray Industries, Inc.) are given in Table 1. Prior to performing the evaluation for the handleability of the fiber bundle, the twist count measured with one end left free, and the number of maximums and the helical pitch of the fiber bundle, the carbon fiber bundle was subjected twice to the procedure of immersing it in toluene at room temperature for 1 hour and immersing it in acetone at room temperature for 1 hour, and then it was dried in air in a cold, dark, substantially windless place for 24 hours or more.

Reference Example 2

Evaluation results of a carbon fiber bundle of Torayca (registered trademark) M35J (manufactured by Toray Industries, Inc.) are given in Table 1. Prior to performing the evaluation for the handleability of the fiber bundle, the twist count measured with one end left free, and the number of maximums and the helical pitch of the fiber bundle, the carbon fiber bundle was subjected twice to the procedure of immersing it in toluene at room temperature for 1 hour and immersing it in acetone at room temperature for 1 hour, and then it was dried in air in a cold, dark, substantially windless place for 24 hours or more.

Reference Example 3

Evaluation results of a carbon fiber bundle of Torayca (registered trademark) M40J (manufactured by Toray Industries, Inc.) are given in Table 1. Prior to performing the evaluation for the handleability of the fiber bundle, the twist count measured with one end left free, and the number of maximums and the helical pitch of the fiber bundle, the carbon fiber bundle was subjected twice to the procedure of immersing it in toluene at room temperature for 1 hour and immersing it in acetone at room temperature for 1 hour, and then it was dried in air in a cold, dark, substantially windless place for 24 hours or more.

Reference Example 4

Evaluation results of a carbon fiber bundle of Torayca (registered trademark) M46J (manufactured by Toray Industries, Inc.) are given in Table 1. Prior to performing the evaluation for the handleability of the fiber bundle, the twist count measured with one end left free, and the number of maximums and the helical pitch of the fiber bundle, the carbon fiber bundle was subjected twice to the procedure of immersing it in toluene at room temperature for 1 hour and immersing it in acetone at room temperature for 1 hour, and then it was dried in air in a cold, dark, substantially windless place for 24 hours or more.

Reference Example 5

Evaluation results of an unsized carbon fiber bundle of Torayca (registered trademark) T300 (manufactured by Toray Industries, Inc.) are given in Table 1.

TABLE 1

| | Precursor fiber | | | | Carbon fiber bundle | | | | |
|---|---|---|---|---|---|---|---|---|---|
| | bundle fineness | Twisting | Carbonization | | diameter of | | | | strand |
| | single fibers dtex | twist count turns/m | maximum temperature ° C. | tension mN/dtex | single fibers μm | density g/cm$^3$ | filament number number | strand strength GPa | elastic modulus GPa |
| Example 1 | 1.1 | 5 | 1,400 | 1.5 | 7.5 | 1.78 | 12,000 | 4.9 | 278 |
| Example 2 | 1.1 | 20 | 1,400 | 1.5 | 7.5 | 1.78 | 12,000 | 5.0 | 279 |
| Example 3 | 1.1 | 50 | 1,400 | 1.5 | 7.5 | 1.79 | 12,000 | 5.0 | 277 |
| Example 4 | 1.1 | 75 | 1,400 | 1.5 | 7.5 | 1.78 | 12,000 | 4.9 | 277 |
| Example 5 | 1.1 | 100 | 1,400 | 1.5 | 7.5 | 1.78 | 12,000 | 4.9 | 280 |
| Example 6 | 1.1 | 10 | 1,900 | 3.5 | 7.4 | 1.73 | 12,000 | 4.4 | 337 |
| Example 7 | 1.1 | 50 | 1,900 | 10.2 | 7.2 | 1.74 | 12,000 | 4.3 | 392 |
| Example 8 | 1.1 | 75 | 1,900 | 6.1 | 7.4 | 1.72 | 12,000 | 4.1 | 367 |
| Example 9 | 1.1 | 100 | 1,900 | 5.4 | 7.4 | 1.73 | 12,000 | 4.1 | 363 |
| Example 10 | 1.1 | 5 | 1,900 | 10.2 | 7.2 | 1.74 | 12,000 | 4.0 | 391 |
| Example 11 | 1.1 | 10 | 1,900 | 10.2 | 7.2 | 1.74 | 12,000 | 4.1 | 392 |
| Example 12 | 1.1 | 10 | 1,400 | 3.5 | 7.4 | 1.78 | 12,000 | 5.1 | 292 |
| Example 13 | 1.1 | 50 | 1,400 | 7.8 | 7.2 | 1.79 | 12,000 | 5.2 | 328 |
| Example 14 | 1.1 | 100 | 1,400 | 6.9 | 7.3 | 1.78 | 12,000 | 5.1 | 316 |
| Example 15 | 1.1 | 50 | 1,900 | 4.4 | 7.4 | 1.72 | 24,000 | 4.2 | 335 |
| Example 16 | 1.1 | 75 | 1,900 | 3.0 | 7.4 | 1.72 | 24,000 | 4.0 | 328 |
| Example 17 | 1.1 | 100 | 1,900 | 5.0 | 7.4 | 1.72 | 24,000 | 4.1 | 340 |
| Example 18 | 1.1 | 8 | 1,900 | 10.2 | 7.2 | 1.72 | 24,000 | 4.1 | 391 |
| Example 19 | 1.1 | 35 | 1,900 | 10.2 | 7.2 | 1.73 | 24,000 | 4.2 | 392 |
| Example 20 | 1.1 | 45 | 1,900 | 10.2 | 7.2 | 1.72 | 24,000 | 4.2 | 390 |
| Comparative Example 1 | 1.1 | 0 | 1,900 | 7.5 | 7.1 | 1.77 | 12,000 | 4.6 | 374 |
| Comparative Example 2 | 1.1 | 0 | 1,900 | 10.2 | — | — | — | — | — |
| Comparative Example 3 | 1.1 | 0 | 1,400 | 5.4 | 7.4 | 1.79 | 12,000 | 4.6 | 314 |
| Comparative Example 4 | 1.1 | 2 | 1,400 | 2.1 | 7.5 | 1.78 | 12,000 | 4.8 | 278 |
| Comparative Example 5 | 1.1 | 1 | 1,900 | 1.5 | 7.5 | 1.74 | 12,000 | 4.9 | 314 |
| Comparative Example 6 | 1.1 | 0 | 1,900 | 2.1 | 7.4 | 1.74 | 12,000 | 4.8 | 319 |
| Comparative Example 7 | 0.8 | 45 | 1,400 | 10.3 | 5.3 | 1.81 | 12,000 | 5.3 | 361 |
| Reference Example 1 | — | — | — | — | 7.0 | 1.80 | 12,000 | 4.9 | 230 |
| Reference Example 2 | — | — | — | — | 5.2 | 1.75 | 12,000 | 4.7 | 343 |
| Reference Example 3 | — | — | — | — | 5.2 | 1.75 | 12,000 | 4.4 | 377 |
| Reference Example 4 | — | — | — | — | 5.1 | 1.84 | 12,000 | 4.2 | 436 |
| Reference Example 5 | — | — | — | — | 6.9 | 1.76 | 12,000 | 3.5 | 230 |

TABLE 1-continued

| | Carbon fiber bundle | | | | | | | |
|---|---|---|---|---|---|---|---|---|
| | crystallite size $L_c$ (b) nm | orientation parameter of crystallites $\pi_{002}$ (b) % | formula (1) * | bundle forming property — | twist count measured with one end left free turns/m | twist angle measured with one end left free ° | heat loss rate at 450° C. % | number of single fiber breakage points number/$m^2$ |
| Example 1 | 1.98 | 82.2 | true | good | 5 | 0.7 | 0.06 | 1.0 |
| Example 2 | 1.98 | 82.1 | true | good | 19 | 2.8 | 0.06 | 0.5 |
| Example 3 | 1.97 | 82.1 | true | good | 47 | 6.9 | 0.03 | 0.8 |
| Example 4 | 1.99 | 82.0 | true | good | 74 | 10.8 | 0.06 | 1.0 |
| Example 5 | 1.98 | 81.9 | true | good | 98 | 14.2 | 0.06 | 1.2 |
| Example 6 | 2.74 | 84.5 | true | good | 9 | 1.3 | 0.06 | 0.8 |
| Example 7 | 2.94 | 87.2 | true | good | 47 | 6.6 | 0.03 | 1.3 |
| Example 8 | 2.84 | 85.6 | true | good | 74 | 10.7 | 0.03 | 1.5 |
| Example 9 | 2.81 | 85.1 | true | good | 97 | 13.9 | 0.03 | 1.3 |
| Example 10 | 2.93 | 87.0 | true | good | 5 | 0.7 | 0.03 | 9.3 |
| Example 11 | 2.94 | 87.1 | true | good | 10 | 1.4 | 0.03 | 4.5 |
| Example 12 | 1.99 | 82.3 | true | good | 10 | 1.5 | 0.06 | 1.0 |
| Example 13 | 2.04 | 82.8 | true | good | 47 | 6.6 | 0.06 | 1.1 |
| Example 14 | 2.05 | 82.7 | true | good | 98 | 13.8 | 0.06 | 2.6 |
| Example 15 | 2.77 | 84.6 | true | good | 48 | 9.8 | 0.04 | 1.2 |
| Example 16 | 2.74 | 84.6 | true | good | 75 | 15.2 | 0.05 | 1.6 |
| Example 17 | 2.81 | 84.8 | true | good | 97 | 19.3 | 0.05 | 2.0 |
| Example 18 | 2.93 | 87.2 | true | good | 8 | 1.6 | 0.05 | 9.8 |
| Example 19 | 2.94 | 87.1 | true | good | 33 | 6.6 | 0.05 | 1.1 |
| Example 20 | 2.94 | 87.1 | true | good | 43 | 8.6 | 0.05 | 1.5 |
| Comparative Example 1 | 2.88 | 86.1 | true | bad | 0 | 0 | 0.06 | 7.8 |
| Comparative Example 2 | — | — | — | — | — | — | — | — |
| Comparative Example 3 | 2.00 | 82.5 | true | bad | 0 | 0 | 0.06 | 6.9 |
| Comparative Example 4 | 1.96 | 82.1 | true | good | 2 | 0.3 | 0.20 | 1.5 |
| Comparative Example 5 | 2.75 | 83.2 | false | bad | 1 | 0.1 | 0.20 | 1.5 |
| Comparative Example 6 | 2.76 | 83.5 | false | bad | 0 | 0 | 0.30 | 2.1 |
| Comparative Example 7 | 2.06 | 85.6 | true | good | 43 | 4.5 | 0.30 | 8.8 |
| Reference Example 1 | 1.96 | 81.0 | false | bad | 0 | 0 | 1.00 | 0.6 |
| Reference Example 2 | 3.33 | 86.2 | false | bad | 13 | 1.3 | 1.10 | 0.9 |
| Reference Example 3 | 3.71 | 87.9 | false | bad | 9 | 0.9 | 1.20 | 1.1 |
| Reference Example 4 | 4.90 | 90.9 | false | bad | 13 | 1.3 | 1.20 | 1.0 |
| Reference Example 5 | 1.80 | 80.3 | false | good | 14 | 1.9 | 0.06 | 0.8 |

*"true" means meeting formula (1), and "false"means falling to meet formula (1).

INDUSTRIAL APPLICABILITY

Having a semi-permanent twist, the carbon fiber bundle has high bundle forming property as a characteristic of the fiber bundle itself and does not require a sizing agent to develop bundle forming property and, therefore, it is substantially free from thermal degradation products from a sizing agent and can be molded at a high temperature while maintaining high handleability and enhanced high-order processability. This results in a reduction in the molding cost and improvement in performance for carbon fiber reinforced composite materials containing highly heat-resistant resins as matrix, and therefore, it has industrial use value in the markets of industrial carbon fiber reinforced composite materials, which are expected to be in much greater demand in the future.

The invention claimed is:

1. A carbon fiber bundle that satisfies: retaining a twist count of 2 turns/m or more when suspended with one end fixed and the other end free; having a single fiber diameter of 6.1 μm or more and a heat loss rate at 450° C. of 0.15% or less, and formula (1) wherein $L_c$ is crystallite size and $\pi_{002}$ is an orientation parameter of crystallites determined from bulk measurement of the entire fiber bundle:

$$\pi_{002}>4.0\times L_c+73.2 \quad (1).$$

2. The carbon fiber bundle as set forth in claim 1, wherein the remaining twist count is 16 turns/m or more.

3. A carbon fiber bundle as set forth in claim 2, wherein the strand elastic modulus is 200 GPa or more.

4. The carbon fiber bundle as set forth in claim 2, wherein the strand elastic modulus is 240 GPa or more.

5. The carbon fiber bundle as set forth in claim 2, wherein the filament number is 10,000 or more.

6. A carbon fiber bundle as set forth in claim 1, wherein the strand elastic modulus is 200 GPa or more.

7. The carbon fiber bundle as set forth in claim 1, wherein the strand elastic modulus is 240 GPa or more.

8. The carbon fiber bundle as set forth in claim 1, wherein the filament number is 10,000 or more.

9. The carbon fiber bundle as set forth in claim 1, wherein the remaining fiber bundle surface layer twist angle is 2.5° to 12.5° .

10. A carbon fiber bundle that satisfies: retaining a surface layer twist angle of 0.2° or more when suspended with one end fixed and the other end free; having a single fiber diameter of 6.1 μm or more and a heat loss rate at 450° C. of 0.15% or less, and formula (1) wherein $L_c$ is crystallite size and $\pi_{002}$ is an orientation parameter of crystallites determined from bulk measurement of the entire fiber bundle:

$$\pi_{002}>4.0\times L_c+73.2 \quad (1).$$

11. The carbon fiber bundle as set forth in claim 10, wherein the remaining fiber bundle surface layer twist angle is 2.0° or more.

12. The carbon fiber bundle as set forth in claim 10, wherein the remaining fiber bundle surface layer twist angle is 2.5° to 12.5° .

13. A method of producing a carbon fiber bundle having a single fiber diameter of 6.1 μm or more and a heat loss rate at a temperature of 450° C. of 0.15% or less, comprising:

performing stabilization of a precursor fiber bundle for polyacrylonitrile based carbon fiber, pre-carbonization thereof, and carbonization thereof performed in this order, a twist count and tension of the fiber bundle being 2 turns/m or more and 1.5 mN/dtex or more, respectively, in the carbonization step.

14. The method as set forth in claim 13, wherein the filament number of the carbon fiber bundle is 10,000 or more in the carbonization step.

15. A method of producing a carbon fiber bundle retaining a surface layer twist angle of 0.2° or more when suspended with one end fixed and the other end free and having a single fiber diameter of 6.1 μm or more and a heat loss rate at a temperature of 450° C. of 0.15% or less, comprising:

performing stabilization of a precursor fiber bundle for polyacrylonitrile based carbon fiber, pre-carbonization thereof, and carbonization thereof performed in this order, tension of the fiber bundle being 1.5 mN/dtex or more in the carbonization step.

16. The method as set forth in claim 15, wherein the filament number of the carbon fiber bundle is 10,000 or more in the carbonization step.

* * * * *